United States Patent [19]

Hwang

[11] Patent Number: 4,835,518

[45] Date of Patent: May 30, 1989

[54] ACTIVE ENTRY DELAY DEVICE

[76] Inventor: Shih-Ming Hwang, No. 11, Alley 12, Lane 7, Ching-Tyan St., Taipei, Taiwan

[21] Appl. No.: 9,246

[22] Filed: Jan. 30, 1987

[51] Int. Cl.[4] ..... G08B 23/00

[52] U.S. Cl. ..... 340/528; 340/527; 340/426; 340/429

[58] Field of Search ..... 340/528, 527, 539, 63, 340/64, 65; 307/10 AT

[56] References Cited

U.S. PATENT DOCUMENTS

| | | | |
|---|---|---|---|
| 3,585,584 | 6/1971 | Behrend | 340/528 |
| 3,833,895 | 9/1974 | Fecteau | 340/539 |
| 3,969,709 | 7/1976 | Isaacs et al. | 340/528 |
| 4,092,643 | 5/1978 | Stolarczyk | 340/528 |
| 4,257,038 | 3/1981 | Rounds et al. | 340/63 |

*Primary Examiner*—Donnie L. Crosland
*Attorney, Agent, or Firm*—Lane and Aitken

[57] ABSTRACT

An active entry delay device which uses a wired or wireless momentary switch to be placed at edge of door or car door, so that the entry delay device can be initiated by turning on the switch; if the switch is not turned on before opening of door/car door, there will not be any entry delay, and alarm system will be triggered to sound alarm immediately.

3 Claims, 1 Drawing Sheet

ACTIVE ENTRY DELAY DEVICE

BACKGROUND OF THE INVENTION

Generally, burglar alarm systems incorporate an entry delay device to allow disarming of a burglar alarm system within a preset time after opening of door, so that false alarms can be prevented. However, such an entry delay device also allows the burglar time to disarm the alarm. Therefore, the function of the burglar alarm system is impaired. The active entry delay device is a design to eliminate the aforesaid defect.

The active entry delay device according to the present invention is characterized by a wired or wireless momentary switch. Turning on of the said switch will cause an entry delay, so that the user can disarm the burglar alarm system within a preset time. Any person other than the user will be and able to turn on the switch to provide an entry delay and therefore the burglar alarm will be triggered immediately if the door is opened by any person other than user.

SUMMARY OF THE INVENTION

The present invention provides an active entry delay device, particularly an active entry delay device for a burglar-or vehicle-alarm system. It involves the use of a momentary switch connected to an alarm system. Turning on of the switch can initiate an entry delay; there will not be any entry delay if the switch is not turned on. Therefore, only the user can make use of the delay, and the alarm will be triggered immediately if the door is opened by any person other than user.

DESCRIPTION OF THE PREFERRED EMBODIMENT

Figure 1:
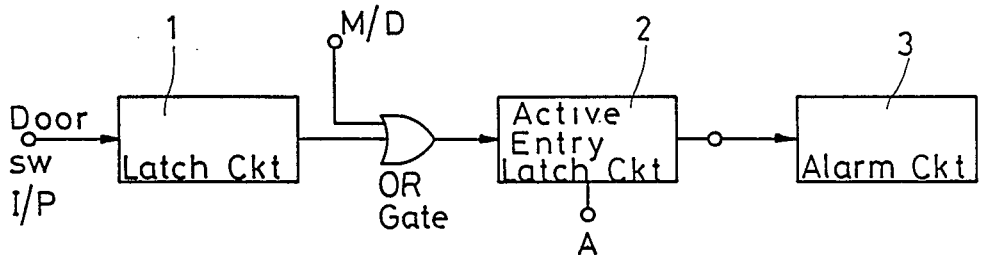
FIG. 1 is a block diagram of a preferred embodiment according to the present invention.

As shown in FIG. 1, a block diagram of a preferred embodiment according to the present invention, a signal detected by a detector of car/burglar alarm system is sent to a latch circuit (1) and latched therein. After the output signal of the latched circuit goes into the OR gate, there is a "Hi" output (the output of OR gate is "Hi"). The signal is entering the active delay device to control the initiation of an entry delay. Absence of entry delay means that the alarm circuit (3) is triggered immediately, and presence of an entry delay would trigger the alarm circuit after elapse of a certain period of time. The active entry delay device will reset after the set period of time if there is no entry in the entry delay period.

Figure 2:
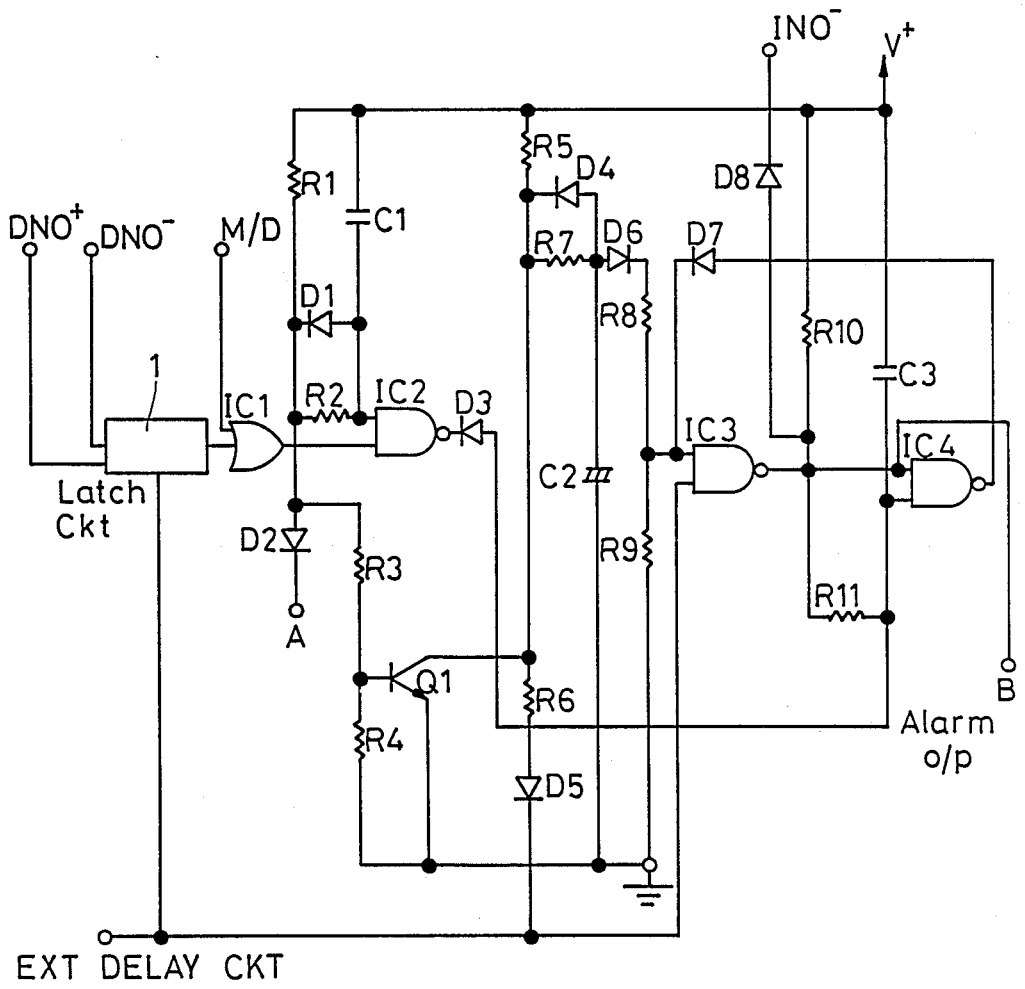
FIG. 2 is a circuit diagram of the embodiment according to the present invention.

As shown in FIG. 2, circuit diagram of the embodiment according to the present invention, DNO+ and DNO− are input points for a signal from a car door detector. In addition to the car door detector, which detects the car door opening and closing, the present invention uses a vibration detector which provides signal input at M/D. The terminal A is a wired or wireless momentary switch and the terminal B is an input point for the alarm driving circuit. For application on an automobile, whenever there is a signal input from DNO+ and DNO−, the signal is latched by the latch circuit (1). Whenever the automobile is disturbed by external force, so that there is a signal input from M/D, there is "Hi" signal input to IC1, and then output of IC2 is "Lo", so output from B is "Lo", there is no entry delay period, and the alarm circuit is triggered immediately. If A is turned on, the active entry latch circuit (2) is activated, and then after opening a car door, a signal from the latch circuit (1) causes IC1 to give a "Hi" output. Since C1 maintains "Lo" by discharge via D1, D2 and A, output of IC2 is "Hi" and thus alarm triggering is delayed. If the alarm system is not disarmed during the delay of R1, R2 and C1, the alarm will be triggered to give an alarm after the delay period. If A is kept "ON" for a period longer than a preset time (determined by R5, R7 and C2), then, because A is earthed, Q1 turns from "ON" to "OFF" so that R5, R7 and C2 are charged, the potential of C2 becomes "Hi", IC3 and IC4 are latched, B turns from "Hi" to "Lo", and the alarm system is triggered to give an alarm.

The present invention uses a wired or wireless momentary switch to turn on A and to initiate an entry delay. If A is turned on for a period longer than a preset time (determined by R5, R7 and C2), the alarm will be triggered immediately.

The present invention can be incorporated into any burglar system for use indoors and outdoors, such as in an automobile, home, etc.

I claim:

1. An alarm system comprising latch circuit means operable when triggered to energize an alarm, detecting means operable when enabled to trigger said latch circuit means to energize said alarm in response to the opening of a door, a momentary switch input terminal, and means responsive to a momentary signal applied to said momentary switch input terminal to disable said detecting means for first predetermined time interval, and means responsive to an input signal on said momentary switch input terminal exceeding in a second predetermined time interval to trigger said latch circuit means to energize said alarm.

2. An alarm system as recited in claim 1 for an automotive vehicle, wherein said detecting means is responsive to the opening of the door of said vehicle to trigger said latch circuit means.

3. An automotive vehicle alarm system as recited in claim 2, wherein said detecting means is operable in response to vibration of said vehicle to trigger said latch circuit means.

* * * * *